United States Patent [19]

Diamond

[11] Patent Number: 4,647,738

[45] Date of Patent: Mar. 3, 1987

[54] REMOTE MANUAL ACTUATOR MEANS FOR A PRESSURE-SWITCH OPERATED DEVICE SUCH AS A WATER PUMP IN A WHIRLPOOL BATH SYSTEM, AND THE LIKE

[76] Inventor: Harvey E. Diamond, 12953 Woodbridge St., Studio City, Calif. 91604

[21] Appl. No.: 694,692

[22] Filed: Jan. 25, 1985

[51] Int. Cl.[4] ..... H01H 35/30

[52] U.S. Cl. ..... 200/81 H; 200/306; 200/83 Z

[58] Field of Search ..... 92/5 R, 181 P; 340/611, 340/626; 200/81 R, 81 H, 82 R, 83 Z, 302, 306, 333, 340, 159 B

[56] References Cited

U.S. PATENT DOCUMENTS 3,736,836 6/1973 McAllister ..... 200/81 H
4,413,214 11/1983 Brown ..... 200/81 H

*Primary Examiner*—G. P. Tolin
*Attorney, Agent, or Firm*—Drucker & Sommers

[57] ABSTRACT

A remote actuator means for a pressure-switch operated device such as a conventional latching relay acting as as on-off switch for an electric motor is provided which comprises a remote spring-loaded actuator cap connected to the device to be actuated via an air actuator conduit. The air actuator conduit communicates with the atmosphere through a vent provided only in the actuator cap. When the operator manually depresses the actuator cap, he or she will automatically cover the vent opening, causing the heretofore open system to be temporarily closed. As the actuator cap is depressed, it compresses air within the now temporarily closed system, causing the latching relay to be "pulsed", which, in turn, activates or deactivates whatever the relay is electrically connected to, e.g., an electric motor driving a water pump in a whirlpool bath system. Because the pressure-switch actuating or deactuating the relay or other device is always open to the atmosphere and is temporarily closed only for actuating or deactuating purposes, the relay, or other device, will not be prematurely triggered by increase in pressure, which would otherwise be the case if the pressure-switch and actuator cap existed in an essentially closed system—as in the prior art.

15 Claims, 6 Drawing Figures

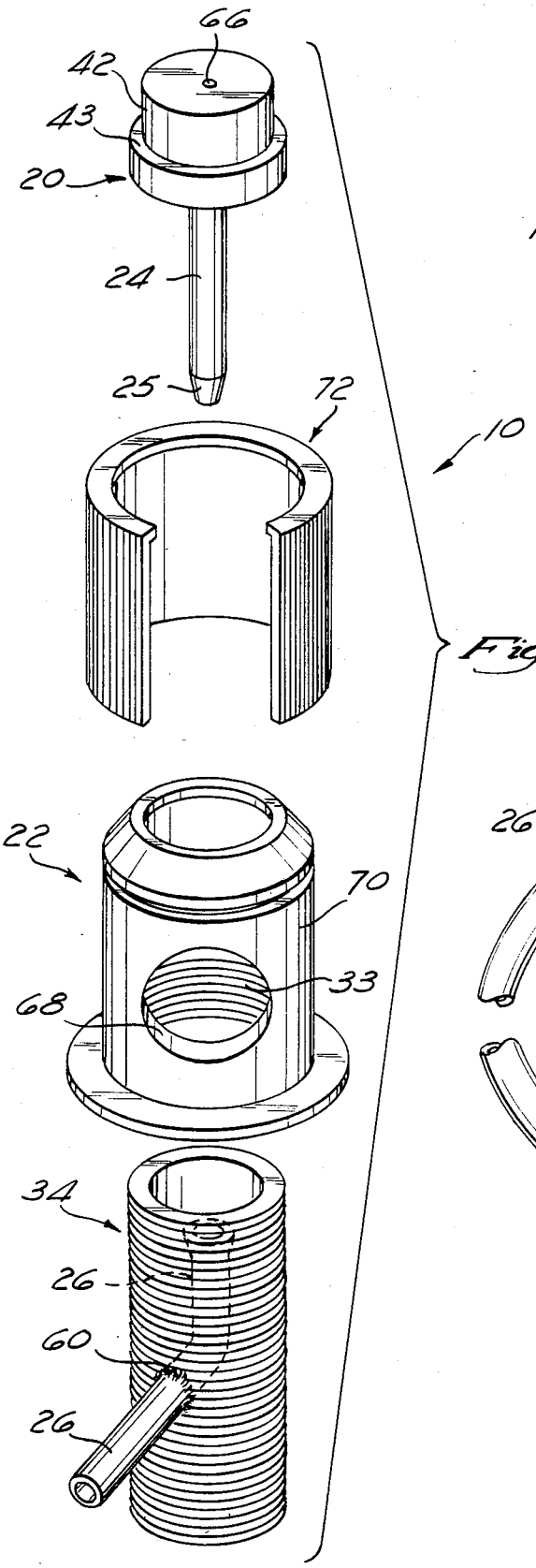
Fig. 1
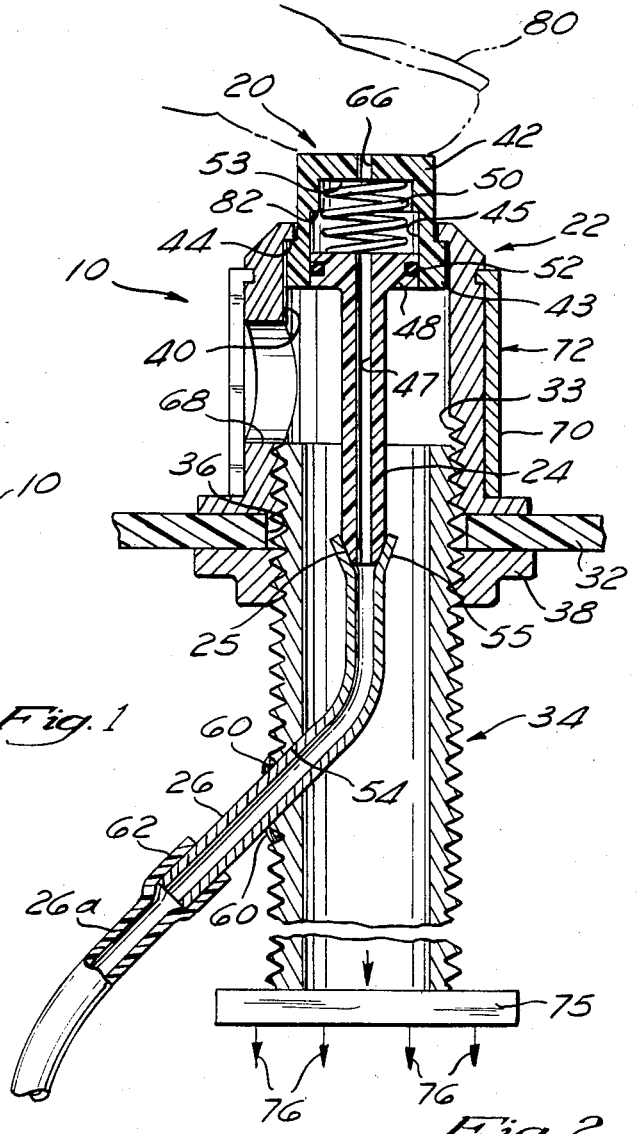
Fig. 2
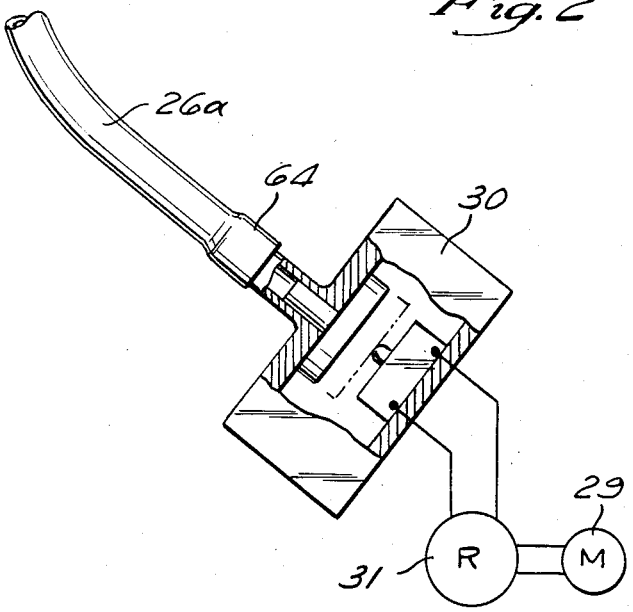

Fig. 3
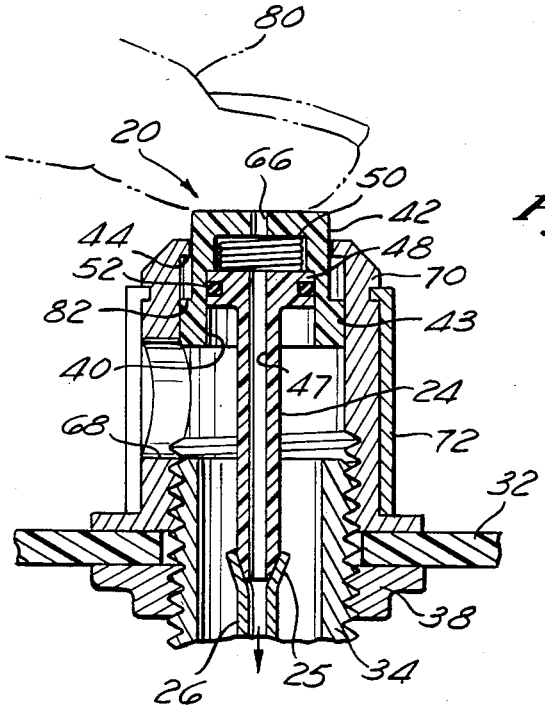
Fig. 4
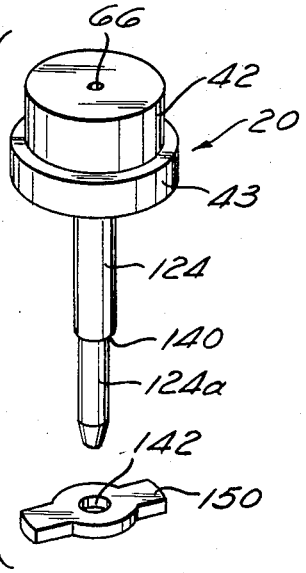
Fig. 6
(PRIOR ART)
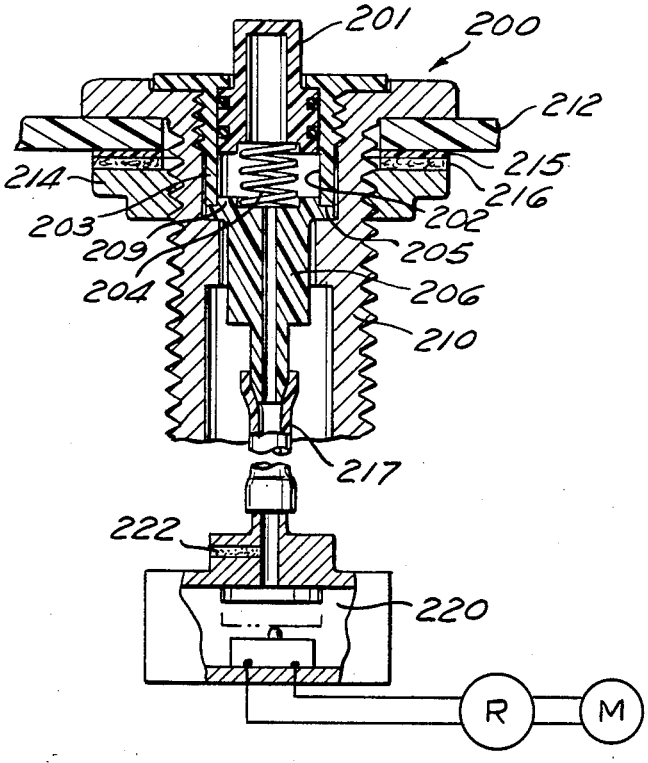
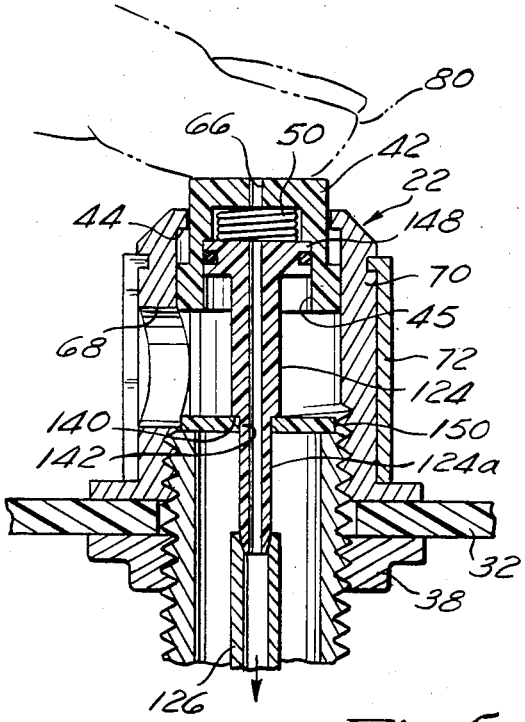
Fig. 5

REMOTE MANUAL ACTUATOR MEANS FOR A PRESSURE-SWITCH OPERATED DEVICE SUCH AS A WATER PUMP IN A WHIRLPOOL BATH SYSTEM, AND THE LIKE

FIELD OF INVENTION

This invention relates to a remotely located manual actuator for a pressure-switch means, which switch means, in turn, actuates a water pump in a whirlpool bath system, or may remotely actuate any other pressure-switch operated device.

BACKGROUND OF THE INVENTION

Whirlpool bath systems of the prior art are provided with a series of jets which are connected to a source of water under pressure, and are also connected to a source of air. The water to the jets is supplied by means of a water pump at a given pressure. The jets are usually of the venturi-type (as, for example, shown and described in applicant's co-pending Ser. No. 572,702, incorporated herein by reference), and as water is passed through the jets, a vacuum is created in the venturi portion of the jets, and entrains, or induces, entry of air, from a suitable side port communicating with an air source, into the water passing through the venturi.

In the prior art, the electric motor driving the water pump, located outside of the bathtub, is generally actuated by a manual actuator means located remotely from the water pump, per se, the remote manually actuated means being generally located on the bathtub wall or upper rim thereof. The remote manual actuator means is, in the prior art, connected to an air actuator conduit, this conduit, in turn, being connected directly to the pressure switch of an electric motor or to a pressure switch connected to a latching relay. The latching relay, in turn, controls the on-off position of the electric motor. The remote actuator means of the prior art may include not only an air actuator conduit between it and the pressure switch, but a compressible section, such as a bellows chamber, which when compressed, compresses the air in the air conduit leading to the pressure switch—thereby actuating the said pressure switch and pulsing the latching relay.

In the closest prior art of which applicant is aware, an axial cross-section of which is shown in FIG. 6, the remote actuator means 200 communicates with the pressure-switch. An actuator button or cap 201 is mounted, for slidable, but continuous sealing, engagement within a bore 202 of cap housing 203. The actuator cap 201 is spring-loaded by spring means 204 held between the upper collar 209 of a depending airway tube 206 and cap 201. Airway tube 206 (made of plastic) is glued to plastic cap housing 203 at 205. This entire assembly, just described, is retained within an externally threaded main housing member 210. The main housing member 210 passes through the bathtub wall 212 and is retained thereto by internally threaded nut 214 and washers 215, 216.

A flexible air tube 217 is mounted to the airway tube 206 of the actuating means 200, tube 217 communicating with a conventional pressure-actuated switch means 220.

The pressure-actuated switch means 220 of the prior art (FIG. 6) is provided with a sintered metal insert 222 or breather communicating with the air passage of air tube of tubing 217. The sintered metal insert 222 permits a very slow bleeding of air to the atmosphere.

This prior art system provides pressure equalization to the pressure-actuated switch means 220, and upon depression of the actuator button 201, still provides a compression of air within air actuator conduit because of the slow bleeding provided by the breather 222.

However, the prior art system described in FIG. 6 is relatively expensive to manufacture due to the requirement of the breather element and the gluing of plastic parts.

The present invention is designed to avoid premature triggering of the water pump, or any other device operated by a pressure switching mechanism, due to changes in ambient pressure, in a simple, less expensive way than that of the prior art just described, or other prior art known to the applicant.

This invention is further designed to be integrated with, i.e., combined with an air supply control and supply system for the jets for the purpose of using common parts and thereby effecting substantial economies in tooling and manufacturing.

SUMMARY OF THE INVENTION

A remote actuator means for a pressure-switch operated device such as a conventional latching relay acting as an on-off switch for an electric motor, is provided which comprises a remote spring-loaded actuator cap or button connected to the device to be actuated via an air actuator conduit. The air actuator conduit is preferably made, partially, or entirely, of flexible tubing for economy. The air actuator conduit communicates with the atmosphere through an atmospheric vent provided only in the actuator button.

When the operator manually depresses the actuator button, he or she will automatically be able to cover the vent opening, causing the heretofore open system to be closed. As the actuator button is depressed, it compresses air within the now temporarily closed system, and causes the latching relay to be "pulsed", which, in turn, activates whatever the relay is electrically connected to, e.g., an electric motor driving a water pump in a whirlpool bath system.

Deactivation of the conventional latching relay, and the equipment it operates, is caused by a second depression of the actuator button, which pulses the pressure-switch, and, in turn, the latching relay.

Because the pressure-switch actuating or deactuating the relay or other device is always open to the atmosphere and is temporarily closed only during the actuating or deactuating operation, the relay, or other device, will not be prematurely triggered by increases in pressure, which would otherwise be the case if the pressure-switch and actuator button existed in an essentially closed system. Moreover, the system of the present invention avoids the use of the expensive "breather" component described with reference to the FIG. 6 prior art.

In the environment of a whirlpool bathtub, the remote actuator system of this invention is preferably physically combined with, and supported by the main air supply line to the whirlpool jets—for economy of manufacture of components. To this end, the actuator button is contained within, but is independent of, the main air supply conduit, and is operatively supported within the main air supply conduit.

BRIEF DESCRIPTION OF THE DRAWINGS

FIG. 1 is an exploded, perspective, view of the component parts of the remote actuator means of a first embodiment of this invention;

FIG. 2 is a longitudinal cross-sectional view of the assembled components of FIG. 1, in non-actuated position, and showing their connection, schematically, to a pressure switch;

FIG. 3 is a partial, longitudinal, cross-sectional view of the assembled components of FIG. 1, in actuated position;

FIG. 4 is a perspective view of the actuator cap of a second embodiment of this invention;

FIG. 5 is a partial, longitudinal, cross-sectional view of said second embodiment of this invention, in actuating position; and FIG. 6 is an axial cross-sectional view of a prior art system for remote actuation of a pressure-switch.

DETAILED DESCRIPTION OF THE PREFERRED EMBODIMENT

Referring to the embodiment shown in FIGS. 1–3, the remote actuator of this invention is designated generally by the numeral 10. The remote actuator 10 comprises an actuator cap means 20, mounted for actuating (and deactuating) linear movement within an actuator cap housing 22. The actuator means 20 is provided with a depending rigid airway tube 24 for connection to air actuator conduit 26, 26*a*, the lower end of air actuator conduit section 26*a* being connected to a pressure-actuated switch 30 of conventional design, such as made by Micro Pneumatic Logic, Inc., Fort Lauderdale, Fla. (Model No. MPL602-2). The pressure-actuated switch 30 is, in turn, electrically connected to a device such as, but not limited to, a latching relay (R), of conventional design, designated by the numeral 31, for switching a motor 29 (M) to on-off positions. The motor 29 may drive a water pump in a whirlpool bath embodiment, although the invention has many other applications.

The remote actuator 10, in the specific embodiment shown, is affixed to a bathtub wall or to an upper surface thereof 32 for easy access by the user, whereas the pressure actuated switch 30, relay 31 and motor 29 are remotely located outside of the bathtub wall.

Referring to FIGS. 1–3 in more detail, the actuator cap housing 22 is provided with a partially internally threaded section 33, threadably engaging an externally threaded main air supply conduit 34. The cap housing 22 is supported by bathtub wall 32, and main air supply conduit 34 passes through an opening 36 provided in the wall 32. The assembly is rigidly held in place to wall 32 by an means of internally threaded nut 38.

The cap housing 22 is provided with a smooth bore 40, above threaded portion 33, within which the actuator means 20 is mounted for linear slideable movement. The actuator means 20 comprises a cap member 42 provided with an internal bore or cavity 45. A rigid depending tube 24, having an air passage 47 formed therein, is provided with an enlarged upper section or collar 48, which slideably interfits within bore 40. Also, the enlarged upper section or collar 48 has an O-ring 52 secured therein, to permit continuous air-tight sealing engagement between bore 45 of cap member 42 and collar 48 during relative sliding movement.

A coil spring means 50, of conventional design, is mounted between the upper surface of upper collar 48 of tube 24, and the inner wall 53 of the cap member 42. The coil spring 50, in its normal uncompressed state, biases the cap member 42 to an uppermost position, as shown in FIG. 2. The cap member 42 is retained within housing 22, against the spring force, by means of the abutment of an enlarged collar section 43, formed on the external surface of cap member 42, against an internal shoulder 44 provided in housing 22.

The lower end 25 of rigid tube 24 is tapered and lies concentrically within main air conduit 34. Sealingly engaged to lower end 25 is the flared upper end 55 of air actuator conduit 26, the air actuator conduit 26 passing through an opening 54 provided in the main air supply conduit 34.

The air actuator conduit section 26 is formed of suitably rigid metal such as brass or copper (or it may be plastic). It is peripherally sealed, as by soldering at 60, to opening 54 of main air supply conduit 34. The air actuator conduit section 26*a* is preferably made of flexible pvc tubing, or the like, has its upper end 62 affixed to conduit section 26 in a conventional airtight manner, and has its lower end 64 affixed to air-pressure-actuated switch shown schematically at 30. Switch 30, in turn, is electrically connected to a conventional latching relay 31 to switch the motor 29 on and off as the relay is pulsed.

The cap member 42 has a vent 66 provided in the upper wall thereof, the vent 66 normally communicating with the atmosphere, i.e., ambient air. The vent 66 lies in air communication with bore 47 of depending airway tube 24 and with air conduit sections 26, 26*a*.

The actuator cap housing 22 for the remote actuator cap means 20 is provided with a circular aperture 68 in the side wall 70 thereof. The aperture 68 lies in communication with the atmosphere. A knurled, partial sleeve 72 is rotatably mounted onto housing side wall 70 so that the aperture 68 may be closed off to varying degrees, depending upon the amount of overlap of the sleeve, proper, with the aperture.

The aperture 68 is the source of air for the main air conduit 34 and is in air communication with an air manifold 75 (shown schematically) which, in turn, is in air communication with jets 76 (also shown schematically). Thus, there is a constant, manually adjustable, air source for the jets 76 from aperture 68, via main air conduit 34.

It is to be noted that, while the main air conduit 34 and housing 22 enclose the remote actuator means 20 and the air actuator conduit section 26, the sources of air supply for the main air conduit 34 and for the air actuator conduit 26, 26*a* are never intermingled and are entirely independent of each other.

To commence operation of the remote actuator means 10 of this invention, one places one's finger 80 over the atmospheric vent 66. By doing this, a closed system is immediately created, leading to the pressure-actuated switch 30. This closed system has a given volume of air. As the cap member 42 is manually depressed, overcoming the force of spring 50, the cap member 42 slides downwardly within bore 40, until the internal shoulder 82, of cap member 42 strikes the collar 48 of tube 24, as best seen in FIG. 3. Air within the thus created closed system is compressed as the volume of the closed system is decreased.

It is to be noted that no air can leak from the temporarily created closed system into housing 22 because cap member 42 is continuously sealed, during sliding movement within bore 40, by means of O-ring 52. It is also to be noted that the depending air tube 24 is held rigidly in place during depression of cap member 42 because it is soldered to, and supported by, air actuator conduit section 26, which is, in turn, supported by the wall of main air supply conduit 34 (see FIG. 2).

As the air is compressed in the closed system leading to the pressure-actuated switch 30, the switch 30 will be actuated and pulse the latching relay 31 to cause it to, in turn, activate (or deactivate) a motor 29. (As earlier mentioned, the principle set forth herein is applicable for actuatation of many other types of devices.)

In the particular environment set forth herein by way of example, much of the remote actuator means 10 is confined within the main air supply conduit 34 for the purpose of compactness and economy. Thus, the actuator cap housing 22 not only acts as a bearing wall for the actuator cap member 42, but, together with rotatable sleeve 72, provides the adjustable air supply to the main air conduit 34. In addition, the main air conduit 34 provides rigid support for the depending air tube 24, the upper enlarged collar 48 of which must be held rigid in order for actuator cap member 42 to be depressed in a reproducible fashion, and must be sealingly engaged to the cavity 45 of actuator cap 42 means at all times.

In a whirlpool system, the actuation of motor 29 will cause water to flow to jets 76 and will entrain air into the venturi portion of the jets, as previously set forth. The volume of air delivered to jets 76 is controlled, for example, by means of the manual adjustment of rotatable sleeve 72 with respect to aperture 68 in housing 22, or by means of a more precise air control system, as shown and described in applicant's concurrently filed application entitled "Air Valve and Liquid Valve Control Apparatus for Whirlpool Baths".

Referring now to the second embodiment shown in FIGS. 4 and 5, like numbers therein refer to like parts previously described with reference to FIGS. 1–4. In this second embodiment, the upper collar section 148 of airway tube 124, slideably and continuously sealingly engaged with cap actuator member 42, is held rigidly in place by means of a bracket support support member 150 rather than by air conduit portion 26 of FIGS. 1–4. This is accomplished as follows: depending airway tube 124 is provided with a shoulder 140 intermediate its ends; the rigid bracket member 150, preferably made of a tough, rigid plastic such as a polycarbonate, has a central aperture 142 through which the narrow-diameter portion 124*a* of depending airway tube 124 passes, until shoulder 140 abuts the bracket support member 150. Air tube 124 cannot move downwardly any further because of such abutment, even when the cap actuator 42 is manually depressed, as shown in FIG. 5. One advantage of the arrangement of FIG. 5 is that there is no need for a rigid air actuator conduit section 26, as shown in FIGS. 1–3. The entire air actuator conduit 126 may comprise less expensive, flexible tubing without any rigid intermediate section.

The bracket support member 150 may be molded as a separate member, as shown, or may be molded as an integral part of airway tube 124, 124*a*.

While several preferred embodiments of this invention have been shown and described, modifications may be made which lie within the skill of the art. Hence, this invention is intended to be limited only by the claims, which follow.

I claim:

1. A remote actuator means and a pressure-activated switch, which comprises:

a housing, mounted at a location remote from the switch;

an air actutator conduit having first and second ends, the first end being connected to the pressure-activated switch; and an actuator cap means retained within said housing and movable therewithin from a first position to a second position, including a vent means to the atmosphere, spring means which extend substantially within the actuator cap means, and means operatively connecting the actuator cap means and the spring means to the second end of the air actuator conduit, such that the air actuator conduit to which the acutator cap means are operatively connected are normally vented to atmosphere through the vent means, and such that the vent means are adapted to be manually blocked while simultaneously manually moving the actuator cap means to the second position thereof so as to generate an increase in air pressure in the air actuator conduit which in turn activates the switch.

2. The remote manual actuator means and pressure-activated switch of claim 1, further characterized by:

said actuator cap means having a cavity in which said spring means are retained.

3. The remote actuator means and pressure-activated switch operated device of claim 1, further characterized by:

said actuator cap means being provided with a non-movable airway tube, said tube having an air passage formed therein and being in direct air communication with said ari actuator conduit.

4. The remote actuator means and pressure-activated switch of claim 1, further characterized by:

a cavity means provided in said actuator cap means; and an elongated non-movable airway tube, having an air passage therein, and having an enlarged collar relative to said air passage, said enlarged collar being slideably engaged within the cavity of said actuator cap means, and said spring means being located between one end of said cavity and said enlarged collar normally biasing said actuator cap means to said first position; and sealing means provided in said enlarged head to continuously seal the cavity during relative sliding movement between said actuator cap means and said enlarged collar, whereby when said actuator cap means is moved from said first position to said second position, while simultaneously blocking said vent means, a closed system is temporarily maintained, leading to said pressure-activated switch for the actuation of said pressure-activated switch.

5. The combination of a remote actuator means and pressure-activated switch of claim 1, with a main air supply conduit, further comprising:

said housing having an aperture formed in the sidewall thereof, said aperture being in communication with the atmosphere, but not in communication with said vent means nor said air actuator conduit; and said main air supply conduit being in communication with said aperture of said housing.

6. The combination of claim 5, further characterized by:

a partial sleeve rotatably mounted onto said housing whereby to adjustably vary the opening of said aperture; and said main air supply conduit having one end communicating with said aperture in said housing, and the other end communicating with at least one jet outlet to thereby vary the air entry thereto by varying the degree of openability of said aperture.

7. The combination of claim 6, further characterized by:

an air manifold, said main air conduit being air-connected to one end of said air manifold, the other end of said air manifold being, in turn, adapted to be connected to at least one jet outlet.

8. The remote actuator device means and pressure-activated switch of claim 1, further characterized by:

said air actuator conduit being made primarily of flexible tubing.

9. The remote actuator device means and pressure-activated switch of claim 3, further characterized by:

said air actuator conduit being made partially of a rigid air tube and partially of a flexible air tube, said rigid air tube being located so as to provide a non-movable support for the said non-movable airway tube.

10. The remote actuator device means and pressure-activated switch of claim 3, further characterized by:

said air actuator conduit being made substantially entirely of flexible tubing, and said non-movable airway tube being rigidly supported against movement of said actuator means by said main air conduit.

11. The remote actuator device means and pressure-activated switch of claim 3, further characterized by:

said air actuator conduit being made, partially, of a rigid air tube, one end of which is rigidly supported by said main air conduit and the other end of which sealingly communicates with, and is located adjacent to, said non-movable airway tube.

12. The remote actuator device means and pressure-activated switch of claim 1, further characterized by:

an interior bore provided in said housing, and said actutator cap means being retained within said bore of said housing, for relative sliding movement therewithin from said first position to said second position;

an aperture of said housing; and a main air supply conduit in communication with said aperture of said housing.

13. A remote actuator means and a pressure-activated switch which comprises:

a housing;

an actuator cap means retained withinn said housing and moveable therewithin from a first position to a second position;

a spring means normally biasing said actuator cap means to said first position;

a vent means, to the atmosphere, provided in said actuator cap means;

an air actuator conduit having a first end connected to said actuator cap means and in air communication with said vent means of said actuator cap means, the second end of said air actuator conduit being operatively connected to a pressure-activated switch whereby, upon movement of said actuator cap means to said second position while simultaneously manually blocking said vent means to the atmosphere, said pressure-activated switch is activated by an increase in pressure within said air actuator conduit;

a main air supply conduit;

said housing having an aperture formed in the sidewall thereof, said aperture being in communication with the atmosphere, but not in direct communication with said vent means nor said air actuator conduit; and said main air supply conduit being in communication within said aperture of said housing.

14. The combination of claim 13, further characterized by:

a partial sleeve rotatably mounted onto said housing whereby to adjustably vary the opening of said aperture;

and said main air supply conduit having one end communicating with said aperture in said housing, and the other end communicating with at least one jet outlet to thereby vary the air entry thereto by varying the degree of openability of said aperture.

15. The combination of claim 14, further characterized by:

an air manifold, said main air conduit being air-connected to one end of said air manifold, the other end of said air manifold being, in turn, adapted to be connected to at least one jet outlet.

* * * * *